United States Patent [19]

Jenkins et al.

[11] Patent Number: 4,737,242

[45] Date of Patent: Apr. 12, 1988

[54] APPARATUS FOR APPLYING A LIQUID COMPOSITION TO A FIBROUS WEB

[75] Inventors: Stanley N. Jenkins, South Glamorgan, Wales; Bronislaw Radvan, Flackwell Heath; Anthony J. Willis, Marlow, both of England

[73] Assignee: The Wiggins Teape Group Limited, Basingstroke, England

[21] Appl. No.: 793,327

[22] Filed: Oct. 29, 1985

[30] Foreign Application Priority Data

Nov. 1, 1984 [GB] United Kingdom ..... 8427704

[51] Int. Cl.[4] ..... D21F 1/00

[52] U.S. Cl. ..... 162/322; 162/186

[58] Field of Search ..... 162/184–186, 162/300, 322, 203, 204, 208, 299, 308, 348, 183

[56] References Cited

U.S. PATENT DOCUMENTS

| | | | |
|---|---|---|---|
| 1,966,458 | 7/1934 | Novak | 162/184 |
| 2,214,772 | 9/1940 | Muggleton | 162/186 |
| 2,218,547 | 10/1940 | Novak | 162/184 |
| 2,286,924 | 6/1942 | Nicholson | 162/124 |
| 2,665,615 | 1/1954 | Niks | 162/308 |
| 3,463,700 | 8/1969 | Brewster et al. | 162/308 |
| 3,560,334 | 2/1971 | Arledter | 162/175 |

FOREIGN PATENT DOCUMENTS 427531 4/1926 Fed. Rep. of Germany .

*Primary Examiner*—Peter Chin

*Attorney, Agent, or Firm*—Burns, Doane, Swecker & Mathis

[57] ABSTRACT

A method of applying a liquid composition to a moving fibrous web including forming a moving wet-laid fibrous web, partially draining the web and then applying a liquid composition by causing it to flow along a curved surface adjacent the web and in the direction of movement thereof, a foraminous material moving at the same speed and in the same direction of movement of the web being interposed between the surface and the web so that the material is applied to the web through said foraminous material.

12 Claims, 7 Drawing Sheets

FIG. 1
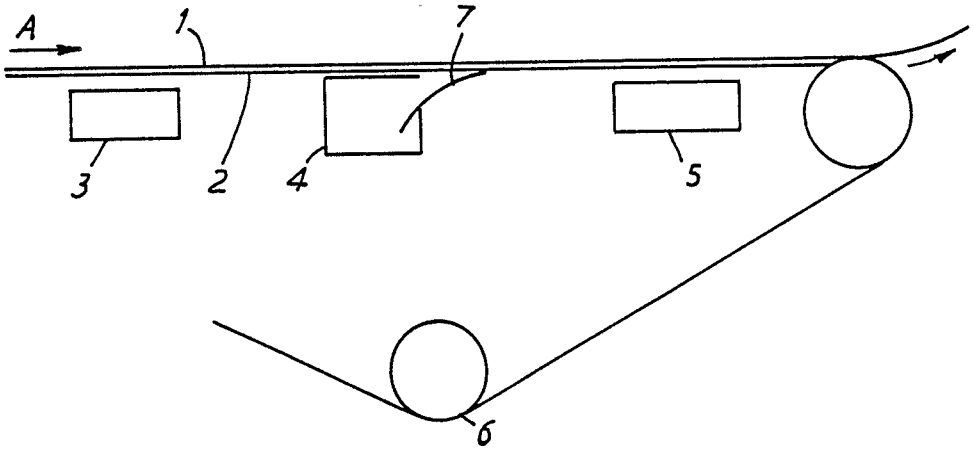
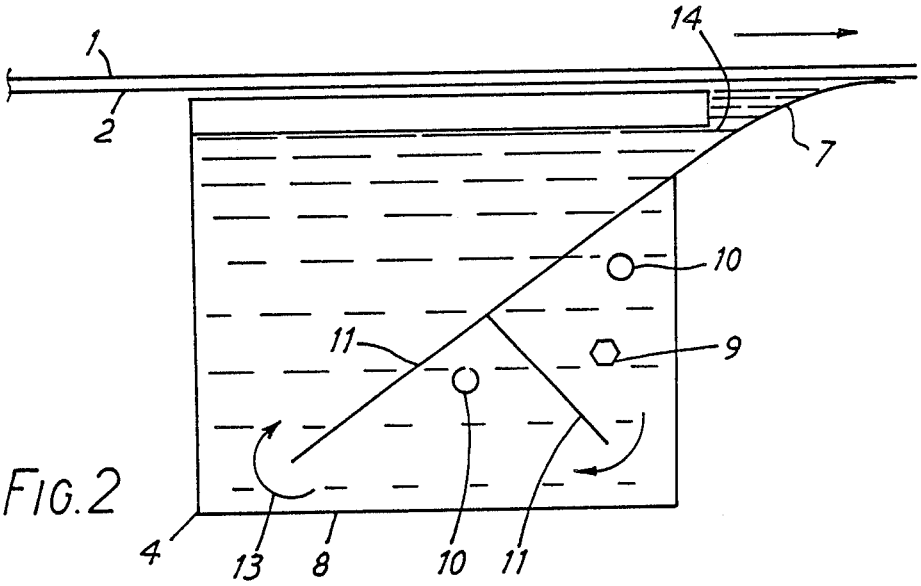
FIG. 2

APPARATUS FOR APPLYING A LIQUID COMPOSITION TO A FIBROUS WEB

The present invention relates to apparatus for applying a liquid composition to a fibrous web, for example a paper web.

When it is desired to apply a coating to a web of paper or non-woven sheet material, or to impregnate it with a liquid, or with a suspension, the web is usually first wet-laid and dried before passing through a coating head where the coating composition is then applied. Once the coating has been applied it is necessary to dry the web again. This means that two drying operations are involved when coating compositions are applied in a conventional manner with a resultant high and expensive energy consumption.

As an alternative to coating a paper web, in order to improve the printing surface and absorption of the printing ink and to give a higher finish and greater opacity to a paper web, it is usual to add mineral fillers or loadings to the papermaking stock. The amount added depends on the purpose for which the paper will be required and the extent to which the loading will be retained on the paper-machine. However, often less than half the loading added with the stock at the wet end reaches the press section of the machine, the remainder being lost by drainage through the wire. Common loadings are kaolin which provides a more respective surface for printing ink and titanium dioxide which is effective for opacity and whiteness. Titanium dioxide in particular is expensive and it is therefore advantageous that as much as possible of that applied is retained in the web, and that it is retained in a well-dispersed state. The two requirements are to some extent contradictory, since it is easier to retain the loading in a coarse, or flocculated condition, than if it is well-dispersed.

It is an object of the present invention to produce apparatus which will satisfy the above requirements for applying liquid composition to a fibrous web so that it is retained in the web to an adequate or improved extent and which overcomes, at least in part, the drawbacks associated with conventional methods.

It has now been found that the above described problems can be eliminated or at least reduced by applying a liquid composition to a wet-laid partially drained fibrous web.

According to the present invention therefor for applying a liquid composition to a moving wet fibrous web includes a stationary guide member having a curved guide surface, a foraminous material having a first surface for engagement with one face of and movement with a moving wet fibrous web, and means for causing liquid composition to flow along the guide surface and through the foraminous material so as to impregnate or form a coating on the web without disruption of the fibrous structure of the web. The foraminous material may be moving at the same speed and in the same direction of movement of the web, being interposed between the surface and the web so that the material is applied to the web through said foraminous material.

Thus, the liquid composition can be applied to the lower surface of the web and could conveniently include wet-laying the fibrous web onto the said foraminous material which is provided beneath it and which is interposed between the web and the curved surface.

Alternatively or additionally the liquid composition can be applied to the upper surface of the web and thus this may include wet-laying the fibrous web onto a foraminous material provided beneath it and applying the liquid composition from the curved surface downwardly through a second foraminous material moving at the same speed and in the same direction as the web.

A vacuum drainage device may be provided to withdraw water from the web after application of the liquid composition. Preferably the foraminous material moves at the same speed and in the same direction of movement of the web between the coating web and the device.

The vacuum drainage device can be located on the same side of the web as the curved surface or it can be located on the opposite side of the web in which case a moving foraminous material is provided on both sides of the web.

Again, if desired, vacuum drainage devices can be provided on both sides of the web.

The foraminous material is preferably a fine wire mesh web, for example, of the kind used as a Fourdrinier wire.

Thus it will be appreciated that the foraminous material can, indeed, be the Foudrinier wire on which the fibrous web is initially formed if the liquid material is to be applied from beneath and an additional wire of a similar kind is provided above the wet-laid fibrous web if the liquid material is to be applied from above.

The apparatus for applying a liquid composition to a moving fibrous web may also include a reservoir having an outlet and a curved surface extending from and adjacent to the outlet, and means for discharging a liquid composition from the outlet to flow along the curved surface adajcent the web in the direction of movement thereof.

The curved surface can be provided in various ways, thus it can be in the form of a curved blade extending from the reservoir. Yet again, it could be provided at the outlet from a delivery passage connected to a reservoir.

Means can be included for controlling the rate of delivery of the liquid composition to the curved surface and when the surface is provided as the outlet for the delivery passage the means for controlling the rate of delivery could include means for adjusting the dimensions of the delivery passage.

The curved surface may be located beneath the fibrous web which is supported on foraminous material in the form of a Fourdrinier wire.

Alternatively the curved surface can be located above the fibrous web and a further foraminous element is then located between the curved surface and the upper side of the web.

With this arrangement the said upper foraminous element can be formed by the surface of a rotating cylinder within which the curved surface is located.

If desired curved surfaces can be provided on both sides of the fibrous web for applying layers of liquid compositions above and below the web through their associated foraminous materials thus providing coatings on both sides of the web.

The present invention may be used to apply several different compositions to a paper web for example titanium dioxide for improving opacity, kaolin for printability and colour developer material and capsules containing colour formers for use in pressure sensitive copying materials.

Applying coatings to the underside of a paper web may provide good one-sidedness i.e. the coating remains concentrated to the side on which it is applied. Also the coating is particularly even because the wire helps distribute the coating composition and also protects the fibrous structure of the web and minimises disruption of the web.

The apparatus may also include a vacuum drainage device which can draw moisture from the web through the foraminous material downstream of the curved surface and on the same side of the web.

Alternatively or additionally a second foraminous material can be provided on the opposite side of the web from the curved surface and a vacuum drainage device can be included which is arranged to draw moisture from the web on the same side as the second foraminous surface.

Again therefore foraminous materials can be provided on both sides of the web and vacuum drainage devices on both sides of the web which draw moisture through their respective foraminous materials.

It might be expected that after applying the coating and as the web moves over the vacuum device to complete the draining process, much of the coating will be sucked out but it has been found that this is not the case, any coating that is removed however can be re-cycled back to the reservoir or reservoirs for re-application.

The present apparatus is also suited to applying additional loadings to the paper web. This enables loading levels above those already present in the papermaking stock to be added. A completely unloaded stock may also be used, with the advantage that it need contain less, if any, retention aid chemicals. The loadings are then added in a relatively concentrated suspension after the stock has been partly drained, and are still well retained. The method thus offers the paper maker an additional degree of freedom in choosing the chemical composition of the stock with less regard to the retention of loadings.

It will also be appreciated that because the process of the invention obviates the need to subject the subsequently dried sheet to an off machine coating operation, sheet strength need not be predetermined by the need to withstand the stresses of coating. As a result, and unless a strong sheet is required for other purposes, furnish costs can be reduced by increasing the non-fibrous filler content.

The present apparatus also eliminates the need for the additional drying stage essential for off machine coating.

It will also be appeciated that by using the apparatus of the present invention one coating can be applied to the underside of the wet web and a further coating applied to the upper side. This is particularly useful when manufacturing pressure sensitive copying paper where the colour developer (CF) coating may be applied by means of the present invention on one side of the paper and the colour former (CB) coating applied further down the paper machine on the other side of the paper to produce a CFB sheet i.e. tandem coating of CF/CB may be achieved on the same machine.

The invention can be performed in various ways and a number of embodiments will now be described by way of example and with reference to the accompanying drawings in which:

FIG. 1 is a diagrammatic side view of underwire coating apparatus according to the present invention;

FIG. 2 is a diagrammatic side view in more detail of part of the underwire coating apparatus shown in FIG. 1;

Figure 3:
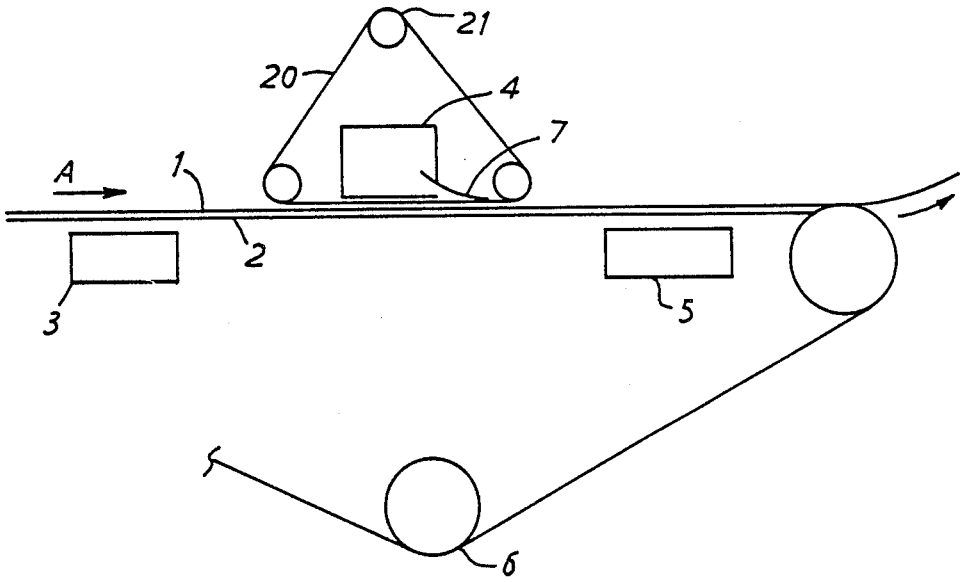
FIG. 3 is a diagrammatic side view of over wire coating apparatus according to the present invention.

Apparatus for coating a paper is shown in FIG. 1. A wet-laid paper web 1 is supported on the second surface of foraminous material provided by a Fourdrinier wire 2 travelling in the direction shown by arrow A. Water drains out of the web 1 through the wire 2. This draining process is speeded up as the web 1 passes over a vacuum device in the form of a vacuum box 3 of known kind in the paper making industry and which removes more water from the web 1. From the vacuum box 3 the web 1 then passes over a coating device 4 located beneath the second surface of the wire 2. This coating device 4 feeds coating composition along a stationary guide member having a curved guide surface provided on a curved blade 7, said surface facing and convergent with said second surface on the underside of the wire 2. The hydrostatic pressure causes the coating to be absorbed into the web 1. After passing over the coating device 4 the web 1 passes over a further vacuum box 5, where more water is removed through the wire 2 and from here onto the dry end of the paper machine.

FIG. 2 shows in more detail the construction of the coating device 4 and which is located under the second surface of the Fourdrinier wire 2 which supports the partially drained wet paper web 1 on its first surface. A liquid coating composition is fed into a reservoir 8 via an inlet pipe 9. Baffles 11 in the reservoir 8 even out the flow of coating composition as shown by the arrows 13. The coating composition then flows out of a nip 14 and along the curved blade 7. The liquid coating composition is absorbed into the under side of the web as a result of the hydrostatic pressure which builds up at the point of contact between the blade 7 and the underside of the wire 2. Bleed screws 10 allow the pressure in the reservoir 8 to be adjusted to control the rate of flow.

In the arrangement shown in FIG. 3 a wet laid paper web 1 is supported on a Fourdrinier wire 2 travelling in the direction shown by arrow A. Water drains out of the web 1, through the wire 2. This draining process is speeded up as the web 1 passes over a vacuum box 3 which removed more water from the web 1. From the vacuum box 3 the web 1 then passes under a coating device 4 which is positioned above the wire 2. This coating device 4 feeds a liquid coating composition along a curved guide surface on a curved blade 7 onto the topside of the web 1 through a foraminous material in the form of a wire mesh 20 which is interposed between the web 1 and the coating device 4. The wire mesh 20 is supported on guide rolls 21. The liquid coating composition is absorbed onto the web as a result of the hydrostatic pressure which builds up at the point of contact between the blade 7 and the wire 2. After passing under the coating device 4 the web 1 passes over a further vacuum box 5 beneath the web where more water is removed through the wire 2 and from here onto the dry end of the paper machine.

The following examples of coated web were made on this type of apparatus.

EXAMPLE 1

This example illustrates the use of the present method and apparatus as shown in FIG. 1 to apply a coating of clay material to the underside of a paper web in order to improve the printability of the paper. A 10% slurry of kaolin (sold under the trade name Dinkie A) was made up containing 8% w/w solution of carboxy methyl cellulose (sold under the trade name Finifix) as binder. This was then coated onto a 65 $gm^{-2}$ base sheet using the underwire coating method.

After coating the percentage Ash was measured to determine how much kaolin had been retained in the web.

| Run | Grammage | % Ash |
|---|---|---|
| 1 | 64.9 | 17.1 |
| 2 | 66.1 | 21.5 |
| 3 | 65.3 | 19.4 |
| 4 | 64.3 | 22.4 |
| 5 | 69.8 | 22.9 |
| 6 | 68.9 | 20.6 |

There was no visible disruption of the web or patchiness of coating.

% Ash is obtained by burning the paper and measuring the amount of mineral matter (ash) which remains. This generally varies from less than 1% (which is the natural mineral matter present in the fibre) to as much as 30% when clay has been added. The % Ash figures obtained in the above example illustrate that a high amount of kaolin has been retained in the web.

EXAMPLE 2

This example illustrates the use of the present method apparatus as shown in FIG. 1 to apply a loading of titanium dioxide to the underside of a paper web in order to improvide the opacity of the sheet.

A well-dispersed mix of 45% solids of titanium dioxide (rutile grade) was impregnated into a paper web of approximately 65–70 $gm^{-2}$ at 10 $lmin^{-1}$.

The following results were obtained.

| Run | Grammage | % Ash |
|---|---|---|
| 1 | 70.8 | 26.7 |
| 2 | 65.1 | 24.3 |
| 3 | 70.3 | 32.0 |

-continued

| Run | Grammage | % Ash |
|---|---|---|
| 4 | 72.8 | 33.5 |

There was no visible disruption of the web, the % Ash providing an indication of the amount of titanium dioxide retained in the web. The paper appeared only slightly two-sided, demonstrating that the suspension of titanium dioxide impregnated well the whole thickness of the web.

EXAMPLE 3

This example illustrates the use of the present method and apparatus as shown in FIG. 1 to apply a coating of capsules and clay to the underside of a paper web in order to prepare a self-contained pressure-sensitive copying material.

A mix of 3% active solids (See Table 1) was coated onto a 35 $gm^{-2}$ paper web using the underwire coating box.

TABLE 1

| | |
|---|---|
| Capsules | 7.7 kg at 19.6% solids |
| Silton clay | 1.5 kg at 19.6% solids |
| Wheatstarch | 0.6 kg at 19.6% solids |
| Water | 90.2 kg at 19.6% solids |

In this case the amount of coating retention was estimated by calculating the amount of mix retained in the web. This was done by measuring samples taken before and after the coating box and comparing this figure with the weight of mix applied to the web.

The results are shown in Table 2. The machine speed is 1.33 $ms^{-1}$ for all runs.

TABLE 2

| Run | 1 | 2 | 3 | 4 | 5 | 6 | 7 | 8 | 9 |
|---|---|---|---|---|---|---|---|---|---|
| Mix Flow rate ($l\ min^{-1}$) | 0 | 10 | 10 | 10 | 10 | 12 | 12 | 15 | 15 |
| Applied Mix grammage ($gm^{-2}$) | 0 | 9.9 | 9.9 | 9.9 | 9.9 | 11.8 | 11.8 | 14.8 | 14.8 |
| Actual Grammage ($gm^{-2}$) | 35.5 | 45.0 | 42.0 | 38.0 | 36.5 | 45.0 | 38.0 | 46.0 | 39.0 |
| Retention (%) | — | 96 | 66 | 25 | 10 | 81 | 21 | 71 | 24 |
| CI (48 hr) | | | | | | | | | |
| Topside | — | 45.0 | 44.0 | 55.0 | 58.5 | 44.0 | 57.5 | 41.5 | 55.5 |
| Wireside | — | 25.0 | 39.5 | 45.0 | 50.5 | 24.0 | 49.5 | 22.0 | 47.5 |
| Comments | Base | No vacuum | Vacuum line on Rotabelt off | Vacuum line off Rotabelt on | Vacuum line on Rotabelt on | No Vacuum | Vacuum line on Rotabelt on | No vacuum | Vacuum line on Rotabelt on |

It was found that better retentions were obtained when no vacuum was applied after the coating device i.e. runs 2, 6 and 8.

The calender intensity (CI) test in this case involves passing strips of the paper under test through a laboratory calender to rupture the capsules and thereby produce a colour on the test strip, measuring the reflectance of the thus coloured strip (I) and expressing the result (I/Io) as a percentage of an unused control strip (Io). Thus the lower the calender intensity value (I/Io) the more intense the developed colour.

The CI value of both the topside and the wire side was measured after 48 hours. A low value indicates high intensity of colour developer. Clearly from the results more colour reacting components are concentrated on the wire side and particularly good results are obtained on the wire side when no vacuum is applied after the coating box. In this case, it is an advantage to have the active components concentrated on one side of the paper, (i.e. "coated") rather than distributed throughout its thickness (i.e. impregnated).

EXAMPLE 4

This examples illustrates the use of the present method and apparatus as shown in FIG. 1 to apply a coating of colour developer to the underside of a paper web to produce a colour developer (CF) sheet for use in pressure-sensitive copying materials.

A standard CF mix was prepared and coated onto a 48 $gm^{-2}$ base paper web at solids contents of 5, 10 and 20%. The pH of the mix was 10.5 except on runs 8, 10 and 11 where it was 12.5. The dryness of the web to be coated was also varied by altering the vacuum from 6 KPa to 18 kPa.

The machine speed in all cases was 1.33 $ms^{-1}$. The smoothness of the web was improved by calendering at 26.27 $kNm^{-1}$ (150 PLI). Runs 13 to 19 were also calendered at 70 $kNm^{-1}$ (400 PLI).

The results obtained are shown in Table 4. All the runs illustrated the good two-sidedness of this coating technique i.e. the coating is concentrated on the wire side of the web. In general, a higher percentage of mix is retained on the base when the base paper web at the point of application contains less water.

In this case the calender intensity (CI) test involves superimposing strips of paper coated with encapsulated colour former solution onto a strip of the coated paper under test, passing the superimposed strips through a laboratory calender to rupture the capsules and thereby produce a colour on the test strip, measuring the reflectance of the thus coloured strip (I) and expressing the result (I/Io) as a percentage of an unused control strip (Io). Thus the lower the calender intensity value (I/Io) the more intense the developed colour.

TABLE 4

| | Run Nos. | | | | | | | | | |
|---|---|---|---|---|---|---|---|---|---|---|
| | 1(Base) | 2 | 3 | 4 | 5 | 6 | 7 | 8 | 9(Base) | 10 |
| Mix solids (%) | — | 10 | 10 | 10 | 10 | 10 | 10 | 10 | — | 10 |
| Applied mix grammage ($gm^{-2}$) | — | 54.8 | 54.8 | 54.8 | 54.8 | 54.8 | 54.8 | 55.7 | — | 55.7 |
| Retained mix grammage ($gm^{-2}$) | — | 11.6 | 10.0 | 19.1 | 7.7 | 6.8 | 3.5 | 7.0 | — | 5.6 |
| Retention (%) | — | 21.2 | 18.2 | 34.8 | 14.1 | 12.4 | 6.4 | 12.8 | — | 10.1 |
| CI (2 mins) | | | | | | | | | | |
| Face | 97.8 | 62.3 | 64.6 | 61.4 | 67.6 | 69.3 | 73.3 | 68.9 | 97.1 | 68.9 |
| Back | 97.2 | 80.4 | 84.5 | 80.0 | 85.9 | 86.2 | 95.5 | 85.4 | 96.1 | 91.5 |
| CI (48 hrs) | | | | | | | | | | |
| Face | 94.2 | 60.1 | 60.7 | 55.3 | 64.0 | 66.0 | 70.5 | 64.4 | 95.0 | 64.1 |
| Back | 98.7 | 77.1 | 81.4 | 76.6 | 82.2 | 83.2 | 93.6 | 80.6 | 93.9 | 88.3 |
| Adhesion | | | | | | | | | | |
| Face | 90 | 20 | 20 | 20 | 50 | 50 | 60 | 40 | 90 | 40 |
| Back | 90 | 70 | 80 | 60 | 70 | 80 | 90 | 90 | 90 | 90 |
| Mix flow rate ($l\ m^{-1}$) | — | 15 | 15 | 15 | 15 | 15 | 15 | 15 | — | 15 |
| Vacuum applied before coating head (kPa) | 16 | 18 | 12 | 18 | 18 | 12 | 6 | 18 | 18 | 13 |
| Base moisture at coating head (%) | — | 82.6 | 85.5 | 82.4 | 81.8 | 85.5 | 89.6 | 82.8 | 82.3 | 83.9 |
| Vacuum applied after coating head (kPa) | Vacuum Vacuum | off line | on | 8 | 18 | 18 | 18 | 18 | 16 | 18 |
| Base moisture at touch (%) | — | 83.3 | 83.0 | 84.1 | 78.4 | 78.1 | 79.4 | 79.0 | 79.5 | 79.7 |

| | Run Nos. | | | | | | | | |
|---|---|---|---|---|---|---|---|---|---|
| | 11 | 12 | 13 (Base) | 14 | 15 | 16 | 17 | 18 | 19 (Base) |
| Mix solids (%) | 10 | 5 | — | 5 | 5 | 20 | 20 | 20 | — |
| Applied mix grammage ($gm^{-2}$) | 55.7 | 43.9 | — | 43.9 | 43.9 | 117.2 | 117.2 | 117.2 | — |
| Retained mix grammage ($gm^{-2}$) | 3.9 | 4.2 | — | 3.6 | 2.2 | 12.6 | 11.2 | 5.4 | — |
| Retention (%) | 7.0 | 9.6 | — | 8.2 | 5.0 | 10.8 | 9.6 | 4.6 | — |
| CI (2 mins) | | | | | | | | | |
| Face | 68.9 | 72.8 | 96.1 *(96.1) | 73.5 (71.4) | 78.4 (75.4) | 65.4 (59.0) | 62.3 (57.4) | 68.7 (65.6) | 96.2 (95.5) |
| Back | 95.4 | 86.6 | 95.2 (97.7) | 93.5 (93.1) | 93.9 (95.9) | 82.1 (83.1) | 85.8 (88.7) | 92.8 (93.9) | 95.4 (95.9) |
| CI (48 hrs) | | | | | | | | | |
| Face | 66.5 | 68.2 | 92.8 (93.6) | 70.1 (69.8) | 74.4 (72.8) | 60.2 (53.4) | 58.2 (53.8) | 67.6 (63.2) | 93.1 (93.0) |
| Back | 91.0 | 83.0 | 93.4 (94.4) | 90.0 (87.0) | 93.1 (93.0) | 76.8 (77.8) | 81.4 (82.2) | 87.6 (89.4) | 92.6 (93.4) |
| Adhesion | | | | | | | | | |

TABLE 4-continued

| | | | | | | | | | |
|---|---|---|---|---|---|---|---|---|---|
| Face | 40 | 70 | 80 | 60 | 60 | 40 | 30 | 50 | 80 |
| Back | 80 | 90 | 80 | 90 | 90 | 80 | 80 | 100 | 90 |
| Mix flow rate ($1\ m^{-1}$) | 15 | 20 | — | 20 | 20 | 15 | 15 | 15 | — |
| Vacuum applied before coating head (kPa) | 6 | 18 | 18 | 12 | 6 | 18 | 12 | 6 | 18 |
| Base moisture at coating head (%) | 90.9 | — | 81.4 | 86.0 | 88.9 | 80.9 | 85.4 | 90.2 | 82.4 |
| Vacuum applied after coating head (kPa) | 18 | 18 | 18 | 18 | 18 | 18 | 18 | 18 | 17 |
| Base moisture at touch (%) | 79.7 | 76.9 | 78.3 | 77.0 | 79.1 | 76.8 | 79.1 | 79.7 | 80.9 |

*brackets indicate samples calendered at 400 PLI

Figure 4:
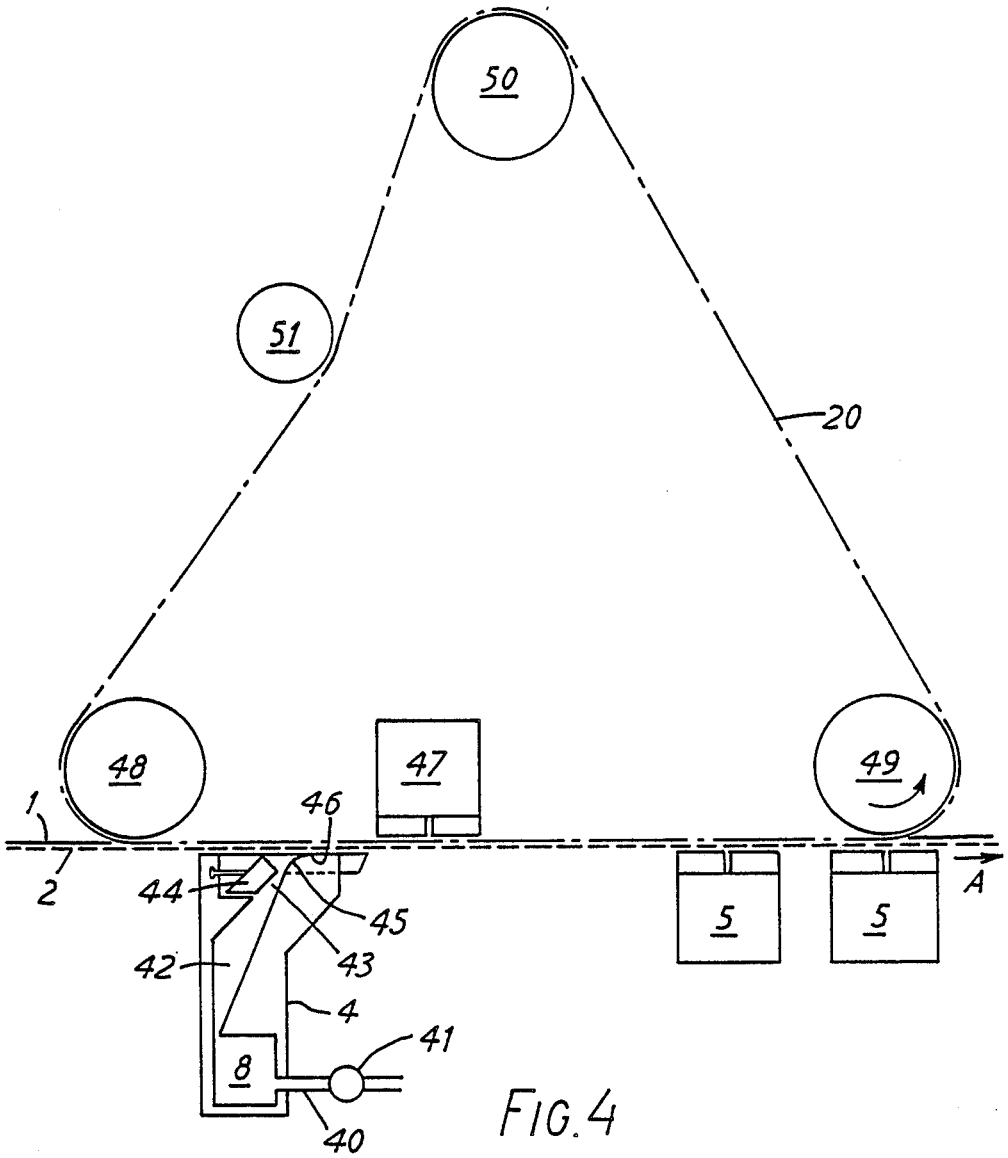
FIG. 4 is a diagrammatic side view of an alternative arrangement with a vacuum device above the web.

FIG. 4 shows a construction which is employed with a Fourdrinier paper machine and similar reference numerals are used to indicate similar parts as in the previous Figures. In the construction shown the paper making stock was deposited on the Fourdrinier wire 2 from a head box of known design (not shown) and was drained by foils and vacuum boxes (not shown) to form a wet web 1 to a condition when its surface no longer appears fluid (usually known as the "dry line").

A coating device 4 comprises a reservoir chamber 8 which is fed from a delivery pipe 40 by a pump 41. The pump 40 delivers a metered quantity of liquid coating composition. The material passes from the reservoir into a delivery passage 42 which has an adjustable slot 43 controlled by an adjustable slide 44. The slot 43 leads to a curved delivery surface 45 with a radius of approximately 2 cm followed by an approximately horizontal surface 46. Two vacuum devices 5 are provided beneath the Fourdrinier wire downstream of the coating device 4 and an additional vacuum device 47 is provided above the web.

As will be seen an additional foraminous element in the form of a wire mesh 20 similar to that shown in FIG. 3 is provided above the web. This wire mesh 20 is interposed between the vacuum device 47 and the web 1 and is carried on an inlet roll 48, a drive roller 49, a stretch roll 50 and a tensioning roll 51. The whole assembly is mounted on a frame (not shown) which can be lifted and lowered by pneumatic means (not shown).

EXAMPLE 5

This example was made on apparatus as shown in FIG. 4. The stock used to form the web 1 consisted of equal proportions of softwood and hardwood sulphate pulps, refined together to a wetness of 60° Schopper-Riegler. The coating mixes used were two of the compositions used in the manufacture of carbonless copying papers. In the first run a "C.F." mix, that is a mix consisting essentially of a reactive clay together with a binder was used. In runs 2 to 5 a mix was used consisting essentially of a mixture of reactive clay with encapsulated colour-forming substance, and a binder.

The technique for manufacture and preparation of these materials are known and do not form part of the present invention. Both mixes were diluted with water to the solids contents indicated in the Table 5 below. The speed of the machine was 18 meters per minute in all cases, other essential conditions and the resulting coating weights are indicated in the Tables.

TABLE 5

| | Run Nos. | | | |
|---|---|---|---|---|
| | 1. | 2. | 3. | 4 |
| Base Grammage $g/m^2$ | 74 | 54 | 54 | 40 |
| Coating Mix: | | | | |
| solids content % by weight | 3 | 3 | 3 | 3 |
| rate of flow l/min. m. width | 31 | 30 | 27 | 30 |
| Vacuum | | | | |
| in Box 5 | low - just sufficient to prevent web transfer | | | |
| in Box 47 | high - (approx. 6" Hg.). | | | |
| in subsequent boxes under the Fourdrinier wire | low - (approx. 2" Hg.). | | | |
| Coating weight $g/m^2$ | 26 | 8 | 6 | 8 |

Samples of the coated web were taken off the downstream part of the Fourdrinier wire 2 and dried by contact with a rotary electrically heated processing drier. The uniformity of the coating, and the degree of penetration of the coating mix into the web were judged visually after the clay samples were passed between the rolls of a calender at a linear pressure of 400 lbs. per square inch, and the colour-forming reaction took place. The uniformity was judged acceptable, and the colour was seen to have developed on the coated side of the web only.

Figure 5:
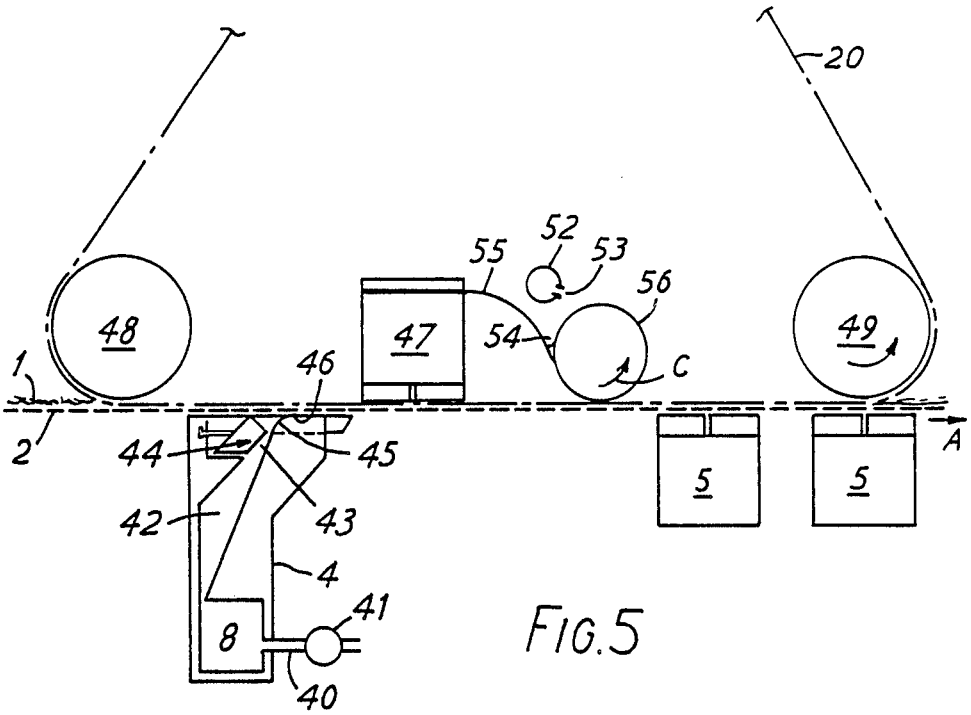
FIG. 5 is a diagrammatic side view of another alternative arrangement.

FIG. 5 shows an arrangement for also applying a liquid material to the upper surface of a web and the same reference numerals are used for similar parts as shown in FIG. 4. This apparatus provides the facility of coating both sides of the web 1 at the wet-end of the paper making machine. It will be seen that a first coating is applied from beneath the web, vacuum then being applied from above the web through the second wire 20 by the vacuum box 47. The second coating is then applied from above the web through the wire 20 and vacuum applied by vacuum boxes 5 located beneath the Fourdrinier wire 2. In this construction the liquid material for the upper surface is delivered through a perforated pipe 52 which acts as a reservoir and the material emerges from the pipe through a series of openings 53 into a pond 54 formed between a transversely extending metering blade 55 and an applicator roll 56. Coating material from the pond 54 is metered onto the roll 56 by the blade 55. The applicator roll 56 rotates in the direction of the arrow C and applies the coating to the upper surface of the web 1 through the wire 20.

It will be understood that the choice of coating mixes used in the above examples does not limit the operation of the invention but was only used as an illustration and for the convenience of the use of the colour reaction to indicate the uniformity of and the position of the coating within the web.

Figure 6:
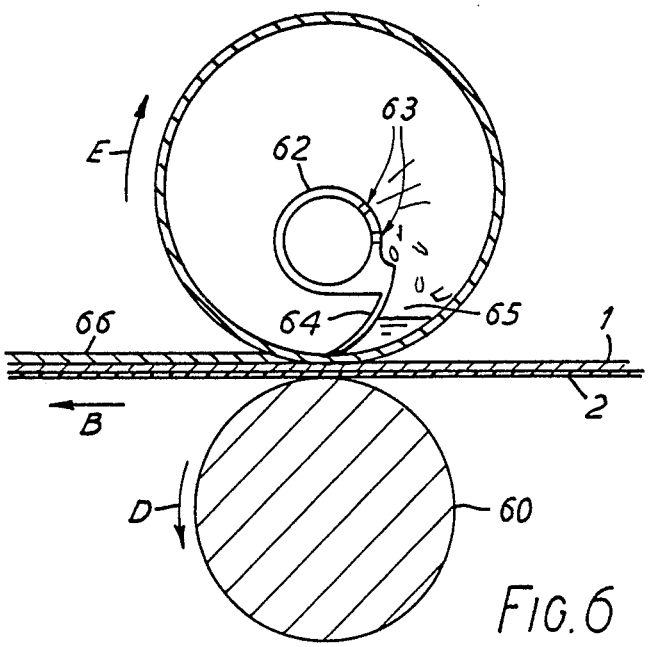
FIG. 6 is a diagrammatic side view of another arrangement for applying a coating to the upper surface of the web.

FIG. 6 shows another construction for applying the liquid coating composition to the upper side of the web and the same reference numerals are again used to indicate the same parts. In this construction the web 1 wet-laid on the Fourdrinier wire 2 moves in the direction of the arrow B over a roller 60 which rotates in the direction of the arrow D. Mounted for rotation above the roller 60 is a wire mesh cylinder 61 which provides a foraminous material and which is driven to rotate in the direction of the arrow E. The outer first surface of the wire mesh cylinder 61 engages and moves with the wet fibrous web 1. Located within the cylinder 61 is a reservoir pipe 62 which has a series of openings 63 through which liquid composition pumped into the pipe 62 can escape. The pipe 62 carries curved guide member having a curved guide surface provided by a a transversely extending blade 64 facing and convergent with the inner second surface of the drum 61. The blade 64 engages the surface of the drum 61 and forms a pond 65 into which the liquid from the opening 63 is delivered. The liquid material is thus applied as a layer 66 to the upper surface of the web 1 through the wire mesh cylinder 61. Suitable vacuum devices can be provided either above and/or below the web downstream of the cylinder to provide the necessary drying effect.

We claim:

1. Apparatus for applying a liquid composition to a moving wet fibrous web of a wet-laying process, comprising:

a foraminous material having first and second surfaces, the first surface for engagement with one face of and movement with a moving wet fibrous web, the foraminous material moving in the direction of the fibrous web movement;

a stationary guide member having a curved fluid-contacting guide surface with a convex shape facing and convergent with the second surface of said foraminous material, opposed to said first surface, in the direction of movement thereof, cooperating with the stationary guide member to define a bounded convergent channel; and, means for causing liquid composition to flow along said curved guide surface and through said foraminous material so as to impregnate or form a coating on said web without disruption of the fibrous structure of the web.

2. Apparatus as claimed in claim 1 in which the curved guide surface is provided at the outlet from a delivery passage connected to a means defining a reservoir.

3. Apparatus as claimed in claim 2 including means for controlling the rate of delivery of the liquid composition to the curved guide surface.

4. Apparatus as claimed in claim 3 in which the means for controlling the rate of delivery includes means for adjusting the dimensions of said delivery passage.

5. Apparatus as claimed in claim 1, in which the foraminous material is the Fourdrinier wire of a paper machine.

6. Apparatus as claimed in claim 1 in which the foraminous material comprises an endless foraminous element disposed above the web.

7. Apparatus as claimed in claim 6, in which the foraminous element comprises a foraminous belt extending around guide rolls.

8. Apparatus as claimed in claim 6, in which the foraminous element comprises a rotatable cylinder and the guide member is located within the cylinder.

9. Apparatus as claimed in claim 1, and further comprising vacuum means disposed to withdraw water from said web after application of said liquid composition.

10. Apparatus as claimed in claim 1 and further comprising a second foraminous material disposed on the other side of said web, said second foraminous material comprising an endless foraminous element movable with and in contact with said web.

11. Apparatus as claimed in claim 10, in which said endless foraminous element comprises a foraminous belt extending around guide rolls.

12. Apparatus as claimed in claim 10, in which said endless foraminous element comprises a rotatable cylinder and the guide member is located within the cylinder.

* * * * *